United States Patent [19]

Christoleit

[11] Patent Number: 4,515,530

[45] Date of Patent: May 7, 1985

[54] DISABLING ARRANGEMENT FOR A RECIPROCATING PISTON COMPRESSOR

[75] Inventor: Arno Christoleit, Hanover, Fed. Rep. of Germany

[73] Assignee: WABCO Westinghouse Fahrzeugbremsen GmbH, Hanover, Fed. Rep. of Germany

[21] Appl. No.: 552,935

[22] Filed: Nov. 17, 1983

[30] Foreign Application Priority Data

Nov. 23, 1982 [DE] Fed. Rep. of Germany ..... 3243165

[51] Int. Cl.[3] ..... F04B 49/00

[52] U.S. Cl. ..... 417/214; 417/470; 417/571

[58] Field of Search ..... 417/214, 470, 571, 319, 417/15; 60/544; 92/13.1

[56] References Cited

U.S. PATENT DOCUMENTS

| | | | |
|---|---|---|---|
| 2,064,750 | 12/1936 | Hurst | 417/214 |
| 2,407,343 | 9/1946 | Pyne et al. | 417/214 |
| 2,699,757 | 1/1955 | Tornkvist et al. | 92/13.1 |
| 2,982,466 | 5/1961 | Pier | 417/214 X |
| 3,072,061 | 1/1963 | Cameron | 417/214 |

FOREIGN PATENT DOCUMENTS

| | | | |
|---|---|---|---|
| 2030642 | 4/1980 | United Kingdom | 417/214 |

*Primary Examiner*—Edward K. Look
*Attorney, Agent, or Firm*—J. B. Sotak

[57] ABSTRACT

A reciprocating piston compressor which is driven by a rotating camshaft and cam. An auxiliary piston is located below the compression piston. The auxiliary piston is movable by a regulated control pressure against the compression piston so that the compression piston is stopped at its top dead center position. Thus, the reciprocating piston compressor is disabled since the compression piston is no longer driven by the rotating camshaft and cam.

9 Claims, 1 Drawing Figure

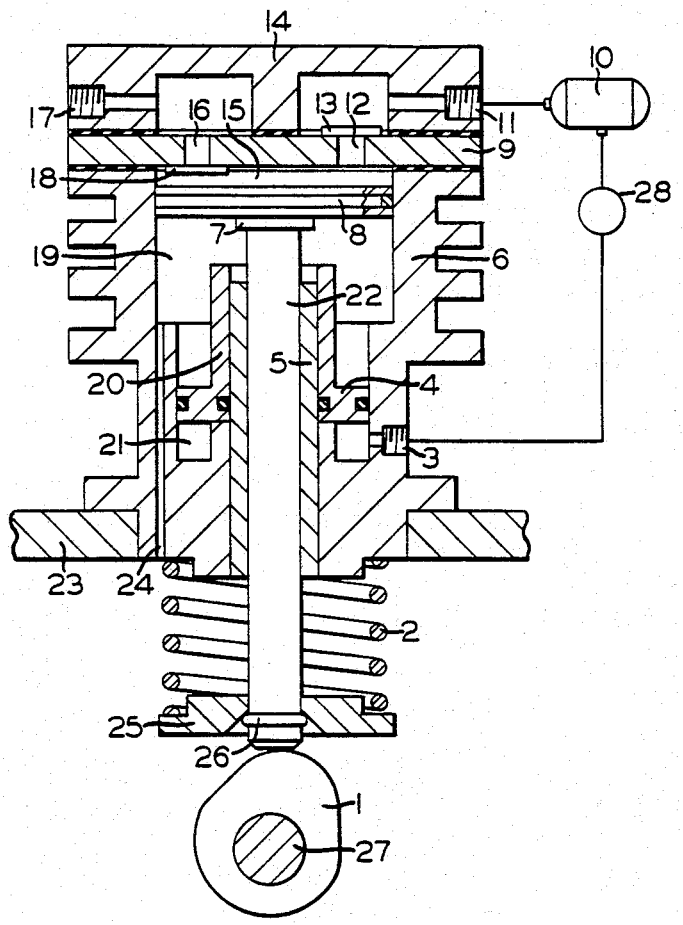
14
10
17
16
15
13
12
11
9
18
28
7
8
19
6
22
5
20
4
21
3
23
24
2
25
26
1
27

DISABLING ARRANGEMENT FOR A RECIPROCATING PISTON COMPRESSOR

FIELD OF THE INVENTION

This invention relates to an arrangement for interrupting the supply of air pressure from a pneumatic reciprocating piston-cylinder compressor, and particularly to a pneumatic compressor having a main piston reciprocating in a cylinder for delivering fluid pressure to a supply reservoir and having an auxiliary piston for disabling the main piston by maintaining the main piston in its top dead center position to disengage the piston push rod from an operating cam.

BACKGROUND OF THE INVENTION

It is common practice in reciprocating piston compressors to drive a piston push rod by a rotating eccentric cam. The remote end of the piston push rod is held in contact with the surface of the cam by the force of a compression return spring. Thus, the cam drives the piston push rod to cause the reciprocating piston to move through a compression stroke of the spring force. Upon completion of the compression stroke, the reciprocating piston is moved by the force of the return spring through a suction stroke.

When such a reciprocating piston-type of compressor is used in a compressed air generating plant, it is necessary to limit the upper pressure level. That is, when the pressure is raised to the appropriate value, it is advisable to unload the reciprocating piston compressor. Further, after the achievement of the desired pressure in the compressed air reservoir, it is highly detrimental to reciprocate the piston under load. In the past, an appropriate pressure regulating valve sensed the compressed air produced by the reciprocating piston compressor after the achievement of the desired pressure, and the pressure was vented into the atmosphere. However, the reciprocating piston compressor still continues to run in an unload condition and is still subject to some degree of wear. Therefore, it would be beneficial to completely disconnect or stop the reciprocating piston of the compressor during periods of no demand.

OBJECTS AND SUMMARY OF THE INVENTION

Accordingly, it is an object of this invention to provide a unique arrangement for stopping a reciprocating piston when the pressure level reaches a predetermined value.

Another object of this invention is to provide an arrangement which simply and safely causes the interruption of the production of air pressure of a compressor.

A further object of this invention is to provide an auxiliary piston for disabling the reciprocating piston of an air compressor.

Yet another object of this invention is to provide a disabling device for arresting the operation of a reciprocating piston to stop further pressure buildup in an auxiliary reservoir.

Yet a further object of this invention is to provide an arrangement for disabling the movement of a reciprocating piston of a pneumatic compressor comprising, a cylinder housing having a compression chamber, a compression piston disposed in the compression chamber and having an operating tappet, a rotating cam engaging the operating tappet for driving the compression piston through a compression stroke, a restoring spring biasing the operating tappet against the rotating cam for driving the compression piston through a suction stroke, and an auxiliary piston cooperatively associated with the compression piston and acted upon by a control pressure to disable the compression piston by holding the compression piston in its top dead center position.

Among the advantages exhibited by this invention is the fact that the reciprocating piston compression can be easily incorporated into an installation for the production of fluid pressure. The fluid pressure produced by the reciprocating piston compressor, after the achievement of a predetermined pressure, can be used to automatically shut down the reciprocating piston. With an appropriate selection of the pressure of the control pressure medium, or of the effective surface of the auxiliary piston acted on by the control pressure medium, it becomes easily possible to apply the desired force for the stopping of the compressor piston.

BRIEF DESCRIPTION OF THE DRAWING

The above objects and other attendant features and advantages of this invention will become more readily apparent and will be better understood by referring to the detailed description when considered in conjunction with the accompanying drawing, wherein:

The single FIGURE shows, partly in section, an elevational view of a pneumatic reciprocating piston compressor having a disabling arrangement for arresting the compression piston in its top dead center position.

DETAILED DESCRIPTION OF THE INVENTION

Referring now to the single FIGURE of the drawing, there is shown a reciprocating compressor having a cylinder housing 6. The housing 6 includes a central bore for accommodating a first reciprocating piston 8. Thus, the reciprocating power piston 8 moves up and down in the cylinder housing 6. The piston 8 is suitably sealed and guided in this cylinder housing 6. The compressor includes a cylinder head 9 which has a valve assembly. The cylinder head 9 is covered by a cylinder head cover 14. Thus, the valve carrying plate 9 is located between the cylinder head cover 14 and the cylinder housing 6. The valve plate 9 is provided with a suction or inlet valve 18 and a dishcarge or outlet valve 13. It will be understood that the reciprocating piston compressor is suitably attached to the crankcase 23 of an internal combustion engine (not shown).

As shown, the piston 8 is guidingly disposed in a lower chamber 19 of the cylinder housing 6 which includes an upper compression chamber 15. The underside or bottom end of the compression piston 8 is provided with a piston stem or rod which serves as an operating plunger or tappet 22. The operating tappet 22 forms an actuating element which is used to drive the compression piston 8.

The compression chamber 15 is connected to atmosphere via the leaf spring suction valve 18, a bore hole 16 formed in the valve support plate 9, and an inlet port 17 formed in the cylinder head cover 14. In most cases, the inlet port 17 is equipped with an air-cleaner filter (not shown). The compresstion chamber 15 is also connected to a compressed air output system via a bore hole 12 formed in the valve support plate 9, the discharge valve 13, and an outlet port 11 formed in the cylinder head cover 14. The compressed air output system is represented schematically by an air storage reservoir 10.

When the movement of the reciprocating piston 8 is in a downward direction, namely, during a suction stroke, air is drawn into the compression chamber 15 from atmosphere to the inlet port 17 and through the open suction valve 18. That is, during the downward motion of the piston 8, a partial vacuum or suction is created in the compression chamber 15 such that atmospheric pressure will force the leaf spring inlet valve 18 open to permit fluid at atmospheric pressure to flow into compression chamber 15. Now, when the piston reaches its lowermost position, the reciprocating piston 8 begins to move upwardly to undergo a compression stroke. During the upward movement, the piston 8 compresses the fluid in chamber 15 to cause the suction valve 18 to automatically close and to cause the discharge valve 13 to open against the force of its leaf spring. Thus, the compressed fluid is permitted to travel through the bore hole 12, passed the open discharge valve 13, through the outlet port 11 into the storage reservoir 10.

In order to produce the downward and upward movements of the compression piston 8, it is necessary to provide a suitable drive arrangement which, in the present case, includes a spring-biased rotary camshaft 27 and an eccentric cam 1 driven by an internal combustion engine. In order to achieve the downward movement of the compressor piston 8, namely, the suction stroke, a compression spring 2 provides the restoring force. As shown, the biasing spring 2 is located between the underside of the cylinder housing 6 and the upper side of a spring retainer 25 which is attached to the free end of the operating tappet 22 by means of a retaining ring 26. Under the force of the compression spring 2, the operating tappet 22 is biased against the free end of the eccentric cam 1. Thus, the compression piston 8, along with the operating stem 22, undergo a reciprocating movement when the camshaft 27 rotates. The cylinder chamber 19, located on the underside of the compression piston 8, is vented to atmosphere by a port 24. Thus, there is no problem with any dashpot action since the chamber is readily filled and evacuated as the compression piston 8 moves up and down.

As shown, the chamber 19 of the cylinder housing 6 is also arranged to accommodate a second or auxiliary piston 4. The lower end of chamber 19 is reduced to receive the enlarged head of piston 4. An inner and an outer sealing ring are carried on the head portion and provide the necessary sealing of the piston 4. As shown, the auxiliary piston is a hollow annular cylinder member which is fitted around the operating tappet 22. A cylindrical guide tube 5 is pressed into the central bore formed in the lower end of housing 6 and is situated between the auxiliary piston 4 and the operating tappet 22. The auxiliary piston rides on the upper outer surface of the guide tube 5, and the entire inner surface is contacted by the tappet 22 and is used as a guide for the operating tappet 22. As shown, a pressure control chamber 21 is provided for the auxiliary piston 4. The control chamber 21 is located between the underside of piston 4 and the upper side of the bottom of housing 16 and is pressurized through an inlet port 3 from a source of fluid control pressure.

When the control chamber 21 is pressurized with a fluid control pressure which, in the present case, may be compressed air, the auxiliary piston 4 is urged upwardly toward the compression piston 8. It will be seen that the upper end of the sleeve-shaped collar 20 forms part of the auxiliary piston 4. As previously mentioned, the piston 4 surrounds the operating tappet 22 and slides on the guide tube 5. As the control pressure moves the auxiliary piston upwardly, its top surface will at some point come in contact with the underside of working piston 8. It will be appreciated that any further upward movement of the pistons 4 and 8 must overcome the force of the compression spring 2. The pressurized chamber 21 will continue to move the piston 4 upwardly until the compression piston 8 reaches the top dead center position which is the same as the uppermost point reached during the compression stroke during normal operation.

The effective working surface of the auxiliary piston 4 acted on by the fluid control pressure and the pressure of the source of fluid control pressure are designed so that the main compression piston 8 is held in its upper dead center position as long as the control chamber 21 is pressurized with the control pressure. This means that the reciprocating piston compressor is effectively disabled during this time and no more compressed air is produced since the rotating cam 1 no longer drives the operating tappet 22. Thus, the compression piston 8 does not move during this time so that the production of compressed air is discontinued and, therefore, there is no frictional wear caused by piston movement. In addition, the camshaft 27 is relieved of expending unnecessary amounts of energy, which is required during the production of compressed air.

Now, when the control chamber 21 is vented to atmosphere, the compression piston 8, as well as the auxiliary piston 4, are again biased downward by the force of the compression spring 2. Thus, the compression piston 8 is again driven by the camshaft 27 and cam 1 to cause the production of compressed air.

In order to prevent the compression piston 8 from striking against the auxiliary piston 4 in its lowermost position, the overall height of the collar 20 is less than the length of the total working stroke of the piston 8 and piston stem 22. In addition, there is a stop member 7 formed on the underside of piston 8 which is adapted to come into contact with the top of the guide tube 5 before the compression piston 8 can contact the auxiliary piston 4.

In order to control the pressure level in the storage reservoir 10, there is provided a pressure regulation apparatus having a pressure regulating valve 28. Thus, fluid pressure is supplied by the pressure regulator to the pressure control chamber 21 when the pressure in the storage reservoir 10 reaches a predetermined value. Thus, the pressurization of the control chamber 21 raises the auxiliary piston 4 to its uppermost position. The upward movement of the auxiliary control piston 4 results in the upward displacement of the main piston 8 until it reaches its upper dead center position. In this manner, the reciprocating piston compressor, once the desired pressure is reached in the storage tank or reservoir 10, is automatically deactivated by disabling the compression piston 8 to hold it in its upper dead center position. When the pressure in the storage reservoir 10 decreases to a certain value, the control chamber 21 is vented to atmosphere by the pressure regulator 28. Thus, the auxiliary piston 4 falls to its lowermost position, and the spring 2 biases the bottom end of the operating stem 22 against the surface of the eccentric cam 1.

Accordingly, the rotation of the camshaft 27 and cam 1 causes the piston rod 22 and piston 8 to reciprocate and, in turn, activates the compressor to again deliver pressurized air to the reservoir 10. The cycling action will be repeated as the air pressure builds up and drops in the storage reservoir.

It will be appreciated that various changes and modifications may be made to the present invention by those skilled in the art; however, it is understood that all variations, alterations, and equivalents falling within the metes and bounds of the present invention are herein meant to be included in the appended claims.

Having thus described the invention, what I claim as new and desire to secure by Letters Patent, is:

1. An arrangement for disabling the movement of a reciprocating piston of a pneumatic compressor comprising, a cylinder housing having a compression chamber, a compression piston disposed in said compression chamber and having an operating tappet, a rotating cam engaging said operating tappet for driving said compression piston through a compression stroke, a restoring spring biasing said operating tappet against said rotating cam for driving said compression piston through a suction stroke, and an auxiliary piston concentrically disposed about said operating tappet and cooperatively associated with said compression piston and acted upon by a control pressure to disable said compression piston by holding said compression piston in its top dead center position.

2. The apparatus, as defined in claim 1, wherein said auxiliary piston which holds the compression piston is located beneath the compression piston.

3. The apparatus, as defined in claim 1, wherein said auxiliary piston is a hollow annular cylinder member which surrounds the operating tappet.

4. The apparatus, as defined in claim 1, wherein said auxiliary piston has a tubular collar for engaging the compression piston and which surrounds the operating tappet.

5. The apparatus, as defined in claim 1, wherein said auxiliary piston surrounds the operating tappet.

6. The apparatus, as defined in claim 1, wherein said spring is disposed between said cylinder housing and said operating tappet.

7. The apparatus, as defined in claim 1, wherein said control pressure acting on said auxiliary piston is the pressure produced by the compression piston.

8. The apparatus, as defined in claim 1, wherein said pressure produced by the compression piston is fed to a pressure storage reservoir, a pressure regulator for limiting the pressure level in said pressure storage reservoir to a predetermined value, and said pressure regulator supplying said control pressure to a control chamber for acting on said auxiliary piston when said pressure level reaches said predetermined value.

9. The apparatus, as defined in claim 1, wherein a stop member is formed on said compression piston which cooperates with said operating tappet to prevent said compression piston from contacting said auxiliary piston when said compression piston is in its lower dead center position.

* * * * *